United States Patent [19]

Säterdal

[11] 4,215,973

[45] Aug. 5, 1980

[54] AXIAL FAN

[75] Inventor: Edgar Säterdal, Rottne, Sweden

[73] Assignee: Aktiebolaget Svenska Flätfabriken, Nacka, Sweden

[21] Appl. No.: 905,029

[22] Filed: May 11, 1978

[30] Foreign Application Priority Data

May 17, 1977 [SE] Sweden ..... 7705827

[51] Int. Cl.[2] ..... F04D 29/36

[52] U.S. Cl. ..... 416/172; 416/146 A; 416/157 R; 416/168 R; 416/205

[58] Field of Search ..... 416/146 A, 157 R, 157 A, 416/157 B, 168 A, 168 R, 174, 205, 245 B, 172

[56] References Cited

U.S. PATENT DOCUMENTS

| | | | |
|---|---|---|---|
| 2,390,068 | 12/1945 | Adams et al. | 416/245 B |
| 3,006,417 | 10/1961 | Busquet | 416/157 C |
| 3,085,631 | 4/1963 | Dagrell | 416/168 |
| 3,175,803 | 3/1965 | Newey et al. | 416/157 R |
| 3,790,301 | 2/1974 | Pedersen et al. | 416/108 |
| 3,844,680 | 10/1974 | Saterdal | 416/157 |
| 4,046,486 | 9/1977 | Kolb | 416/157 R |

FOREIGN PATENT DOCUMENTS

| | | | |
|---|---|---|---|
| 1011419 | 12/1965 | United Kingdom | 416/205 |

*Primary Examiner*—Everette A. Powell, Jr.
*Assistant Examiner*—A. N. Trausch, III
*Attorney, Agent, or Firm*—Fleit & Jacobson

[57] ABSTRACT

There is provided an axial fan having a fan wheel with settable blades, each blade being rotatably mounted at its root end about an axis which extends substantially radially relative to the fan wheel, and carries a setting arm which projects radially outwardly relative to the blade axis, said arm being connected via a movement-transmission arm to a setting device which is common to all said blades and which is displaceably mounted on the fan wheel for movement in the axial direction thereof to change the blade angle. The setting device is also rotatable coaxially in relation to the fan wheel, and each movement-transmission arm is rigidly connected at one end thereof to the setting device. The other end of the movement-transmission arm is mounted in the associated setting arm for both axial and universal movement.

3 Claims, 3 Drawing Figures

AXIAL FAN

The present invention relates to an axial fan having an impeller or fan wheel with settable blades, each blade being mounted at its root end for rotation about an axis which extends substantially radially relative to the fan wheel and carrying a setting arm which projects radially outwardly relative to the blade axis, said setting arm being connected, via a movement-transmission means, to a setting device which is common to all said blades and which is displaceably mounted on the impeller for movement in the axial direction thereof to change the blade angle or pitch.

An axial fan according to the above is previously known, for example, from the U.S. Pat. No. 3,844,680 and has, inter alia, the advantage that the same hub construction and the majority of the means for adjusting the blade angle can be used for fans of different sizes, whereby the fan manufacturer need only store a small number of different components in order to be able to deliver quickly axial fans of different sizes. The movement-transmission means serving to transmit movement between the setting device and the setting arms have the form of arms which are pivotally mounted at each end thereof to the setting device and to the setting arm associated therewith respectively. The forces acting on the bearings of the movement-transmission arms are large and, when the bearings of the setting arms wear and play is formed, give rise to a so-called hysteresis effect, causing the blades to be rotated to different positions for a given movement of the setting device in dependence upon the direction from which the setting device is moved, such that each given position for the setting device does not correspond to a predetermined angular position of the blade. This means that the conveyance of gas by the fan cannot be regulated with sufficient accuracy, such regulation being afforded by the adjustability of the fan blades.

The effect of the present invention is to provide a novel and useful axial fan in which the aforementioned disadvantage is at least substantially eliminated.

To this end it is proposed in accordance with the invention that in the case of an axial fan of the type described in the introduction, the setting device is also rotatable coaxially in relation to the fan wheel, and that each movement-transmission means comprises an arm rigidly connected at one end thereof to the setting device and journalled at its other end in the associated setting arm for both longitudinal and universal movement. By arranging the setting device to be rotatable in relation to the fan wheel, one of the causes of poor precision is eliminated, namely the arrangement of bearing means between the setting device and the movement-transmission arms, whilst simplifying the construction at the same time.

In accordance with a further development of the invention, for maintaining the desired precision of the remaining bearing of each movement-transmission arm, each setting arm may be provided with a sealed bearing housing accommodating a bearing adapted for journalling said other end of the associated movement-transmission arm, and the bearing housing is conveniently arranged to communicate with a chamber for a lubricating or protecting agent extending radially inwardly of the bearing in a manner such that lubricant or protecting agent is forced into the bearing housing by the centrifugal forces created during operation of the fan.

Conveniently each chamber is formed in a blade-attachment shaft extending radially relative to the fan wheel, the inner end of the attachment shaft being rigidly connected to a fan-wheel hub and to the outer end of which attachment shaft the root-end of the associated blade is connected via a bearing serving to rotatably journal said blade, said bearing being held in a sealed bearing housing and the chamber being located radially inwardly of the blade-bearing housing and communicating therewith in a manner such that lubricant or protecting agent is also forced into the blade bearing housing by centrifugal force during operation of the fan. In this way, the blade bearings will also operate under favourable conditions, thereby increasing the reliability of the axial fan and enabling the fan to be used under difficult operational conditions, for example for conveying hot gases, whilst simplifying the fan construction at the same time. An extremely simple construction is obtained herewith when the blade-bearing housing is arranged to communicate with the bearing housing in an associated setting arm, this latter bearing housing being arranged to communicate with said chamber via the blade-bearing housing.

In the axial fan illustrated in U.S. Pat. No. 3,844,680, through-passing holes are arranged in a hub rim associated with the hub of the fan wheel, said holes being arranged to receive the inner ends of the blade-attachment shafts. These holes weaken the hub rim and require the use of a heavily-dimensioned hub rim, which results in a heavy fan wheel. In addition hereto, the blade-attachment shafts in said axial fan are subjected to substantial tensile stresses as a result of the centrifugal forces occurring during operation, and hence these shafts must also be relatively sturdily dimensioned and therewith heavy. These disadvantages are avoided in accordance with the invention by arranging that each blade-attachment shaft is in butt-contact with the radially outer side of the hub and is held pre-tensioned in its axial direction by compression.

Each blade-attachment shaft can be pre-tensioned and connected to the hub by means of screws or the like having a head acting against the radial outer end of the attachment shaft, passing freely through the attachment shaft and being screwed into a respective screw-threaded hole in the hub. In this way, the provision of outwardly projecting construction elements for securing the blade-attachment shaft is avoided in a convenient manner, at the same time as the same means, namely the screws, serve both to secure the shafts and to pre-tension the same.

In order to obtain blade-attachment shafts which are relatively light and which are highly resistant to bending, the attachment shafts may conveniently be tubular.

To enable a single bearing to be used for each blade such as to ensure that the journal is reliable during operation of the fan, each blade-bearing housing may be rigidly connected with an associated blade and surround the radially outer end of the blade-attachment shaft, said blade bearing comprising a thrust bearing located between a flange on the bearing housing directed radially inwardly relative to the blade-attachment shaft, and a flange which is arranged on the blade-attachment shaft and which is directed radially outwardly relative thereto. In this way, any play in the bearing will only slightly influence the precision of the fan wheel during operation, since the centrifugal forces acting on the blades urge the bearing tracks or sliding surfaces of the housing towards each other, thereby fixing the position of the blades. If play is present, however, the fan blades are able to tilt somewhat when the fan wheel is stationary. The fan blades, however, may be fixed in position in a simple manner even when the fan wheel is stationary by means of a spring arrangement adapted to co-operate with each blade and blade-attachment shaft in a manner such as to press said flanges, and therewith the tracks or sliding surfaces of the bearing, towards each other. In accordance with a preferred embodiment each said spring arrangement comprises a compression spring acting between a radially inward end surface on a blade and a radially outer surface on the blade-attachment shaft.

An embodiment of the invention will now be described with reference to the accompanying drawings.

Figure 1:
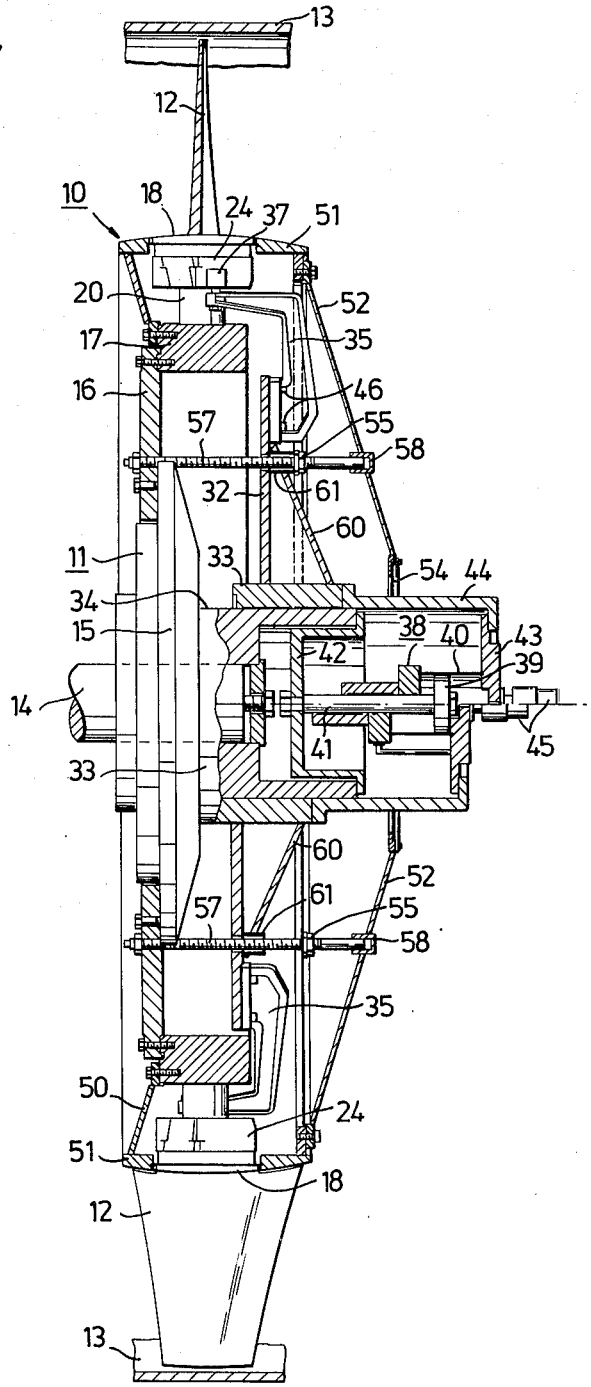
FIG. 1 is an axial sectional view of a fan according to the invention, the blades of the fan being illustrated in different setting positions in the upper and lower half of the Figure.

In the Figures of the drawing there is shown an axial fan having a fan wheel or impeller 10 having a hub 11 which carries settable blades 12. The fan wheel 10 is enclosed in a casing, as indicated at 13, and is rigidly mounted on the end of a shaft 14 which is connected to a drive motor, not shown, for rotating the fan wheel. The hub 11 includes a central part 15 whose periphery connects with a ring-shaped disc 16 which carries on the periphery thereof a hub rim 17.

Each blade 12 is provided with a circular root-part 18 which is rotatably connected, via a bearing 19 (FIG. 3) to the outer end of a blade-attachment shaft 20 extending radially relative to the fan wheel. Each blade-attachment shaft 20 is tubular and abuts at its radially inner end against the radially outer surface of the hub rim 17 in a shallow seating formed therein and is, furthermore, pre-tensioned axially by compression. The blade-attachment shafts 20, which exhibit cylindrical outer surfaces, are pre-tensioned and secured by means of screws 21 having heads which act against the radially outer end of associated attachment shaft 20 via a cover means 22 associated with an attachment shaft, said screws 21 passing freely through the associated attachment shaft and being screwed into threaded holes 23 arranged in the hub rim 17, the screws 21 being tightened to an extent such that the associated attachment shaft 20 obtains the desired degree of pre-tensioning.

Each blade bearing 19 is accommodated in a bearing housing 24 which is sealed against the root-part 18 of an associated blade 12 and against the outside of an associated blade-attachment shaft 20, which housing communicates, via an opening 25 in the cover means 22, with a lubricant chamber 26 located radially inwardly from the bearing housing relative to the fan wheel 10, said chamber 26 being formed by the interior of the tubular attachment shaft 20. To facilitate the introduction of lubricant into the lubricant chambers 26 there are provided channels 27 having nipples (not shown), and non-return valves or the like through which the desired lubricant pressure can be obtained and unintentional departure of lubricant through the passages 27 prevented. It will be understood that lubricant will be forced into the bearing housings 24 to lubricate the bearings 19 effectively therein under the influence of centrifugal forces occurring during operation of the fan and a possible overpressure in the chambers 26. Alternatively, the chambers 26 may be adapted to contain an agent other than lubricant and capable of protecting the bearings against deleterious physical and/or chemical effects from the gas being transported by the fan.

Each bearing housing 19 is held rigidly against the radially inner end surface of the root-part 18 of an associated blade 12 by means of screws or corresponding securing devices not shown, and surrounds the outer end of an associated blade attachment shaft 20. In the illustrated embodiment, each bearing 19 is a thrust ball-bearing located between a flange 28 arranged on the bearing housing 19 and extending radially inwardly relative to the blade-attachment shaft and a flange 29 extending radially outwardly relative to the attachment shaft. The bearing 19 is localised by a cylindrical part of the cover means 22 in a manner such that it is located coaxially with the circular root-part 18 of the associated blade 12. Through the illustrated arrangement the blades 12 with associated root-part 18 and bearing house 24 will be urged radially outwardly by the centrifugal forces occurring during operation of the fan wheel 10, the flanges 28 on the bearing housings 24 urging the tracks and bearing balls located therebetween in a direction towards the flanges of the cover means 22 in a manner such as to fix the position of the fan blade 12 such that no play can occur in the bearing during operation of the fan. When the fan wheel is stationary, the position of each blade is fixed by means of a spring device 30 which strives to urge the flanges 28, 29 towards each other. The spring device 30 comprises a compression spring of small diameter acting between a radially inner end surface of the blade 12 relative to the fan wheel and a radially outer end surface on the blade-attachment shaft 20. More specifically, the spring 30 is accommodated in a recess in the cover member 22. Thus, the spring 30 acts on the attachment shaft 20 via the cover member, and acts on the blade-root part 18 via the head of a self-locking screw 31 screwed into said part 18. The opening 25 in the cover member opens out into the recess accommodating the spring 30, a clearance or groove to enable lubricant to pass to the bearing 19 in the bearing housing 24 in the manner desired being located between the walls of the recess and the cover member 22 in general on the one hand and the spring 30, the screw head and the root part 18 on the other hand. By means of this arrangement lubricant is also passed to the spring device, the bottom of the recess and the screw head so that in this way, and because of the small contact area between the parts, minimum frictional forces occur upon rotation of the blades 12.

For the purpose of rotating the blades 12 in unison and for setting the blades to the desired pitch or angle there is provided a setting device which is common to all blades, said setting device comprising a circular setting plate 32 which is displaceable axially relative to the fan wheel 10. More specifically, the setting plate 32 exhibits a central cylindrical part 33 which is coaxial with the fan wheel 10 and is mounted on a cylindrical part 34 of the central part 15 of the hub 11. The setting plate carries a plurality of movement transmission arms 35 extending between the plate and an associated blade, the end of each of said arms remote from the plate 32 being connected, via bearings 36 (FIG. 3), to a respective blade-setting arm 37 which is rigidly connected with the associated blade 12 and projects radially outwards relative to its axis of rotation, i.e. in a manner such that the bearing 36 is located at a radial distance from the axis of rotation of the associated bearing 19. The blade-setting arms 37 are formed as part of the bearing housings 24 and are connected to the root ends of respective blades 12 via said housings.

Axial movement of the plate 32, which normally rotates together with the fan wheel 10, is effected by means of a double-acting pressure cylinder 38 having a piston 39 and a piston rod 41 projecting outwardly from the cylinder casing 40. The piston rod 41 is firmly connected at its outer end to the hub 11 via a connecting element 42, while the cylinder casing 40 is firmly connected, via elements 42, 44, to the central cylindrical part 33 of the setting plate 32. Connected to the pressure cylinder 38 in a known manner are means 45 for permitting the supply of working medium to one side of the piston 39 or the other during operation of the fan. The supply of working medium can be controlled during operation in a known manner such that the blades 12 are automatically held in positions in which the fan produces, for example, a constant flow of gas, a constant gas pressure etc.

The movement-transmission arms 35 are each rigidly connected at one end thereof to the plate 32 by means of attachment means 46, and are journalled in bearings 36 at their outer end for both longitudinal and universal movement. More specifically, the movement-transmission arms 35 are provided at their journalled end with a shaft or peg 47 which is displaceably accommodated in a bore located in a universally moveable, substantially spherical bearing element, as will best be seen from FIG. 3. Further, the setting plate 32 is also rotatably mounted on the cylindrical hub part 34. When the plate 32 is displaced, the shafts or pegs 47 will move in an arcuate path around the axis of rotation of associated blades 12 during rotation of said blades. At the same time, the setting plate will move slightly around the hub part 34 and the shafts or pegs 47 will carry out a small rotary, tilting and axial movement in associated bearings 36.

Figure 3:
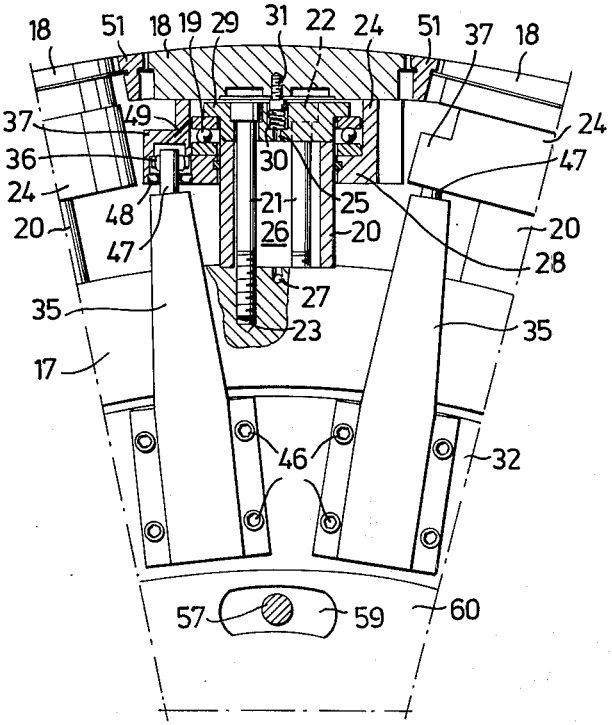
FIG. 3 is a partial end view, partly in section, of the fan shown in FIG. 1, a shield means having been removed in said Figure, in order that the construction of the fan can be seen more clearly.

As illustrated in FIG. 3, the setting arms 37 are so constructed that they form bearing houses for the bearings 36, said bearing houses being sealed by means of seals 48 acting against the shafts 47. The bearing houses formed in the setting arms 37 communicate through channels 49 with the interior of the bearing houses 24 for the bearings 19, the channels 49 being so located that lubricant from the chambers 26 is forced, as a result of centrifugal force during operation of the fan, into the bearing houses of bearings 36 via openings 25 in the cover means 22, the bearing houses 24 and the channels 49.

Figure 2:
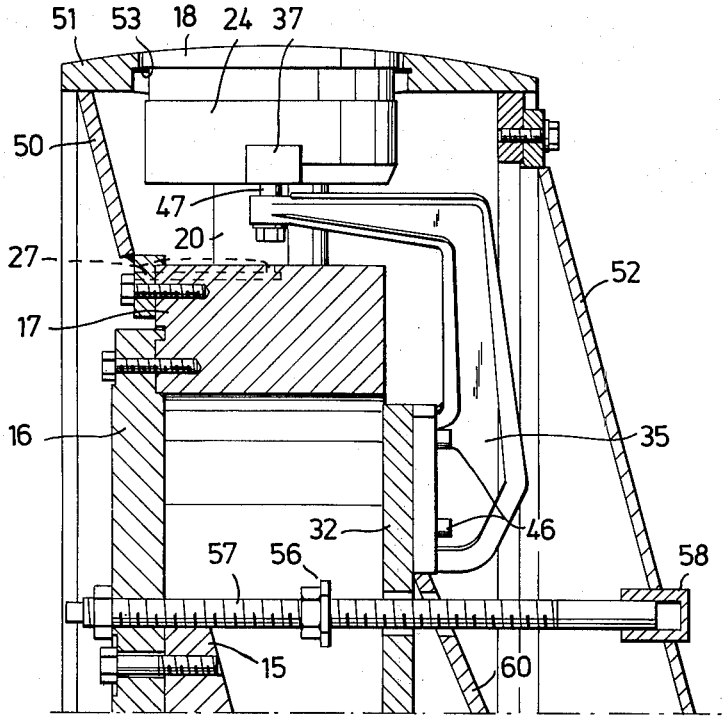
FIG. 2 illustrates in larger scale a portion of the axial sectional view of the fan according to FIG. 1 with the fan blade itself omitted.

For the purpose of shielding the more delicate components of the fan wheel 10 against the gases transported by the fan and for the purpose of, at the same time, producing favourable flow conditions in respect of these gases, the hub 11 has extending therefrom shield elements 50, 51 and 52. The shield element 51 comprises a circumferentially extending plate having circular holes which receive the root-parts 18 of the blades 12, the gaps between said holes and said root-parts, as will best be seen at 53 in FIG. 2, being sealed by means of sealing rings retained in grooves arranged in the defining walls of the holes. The shield element 52 carries at 54 a seal which is operative against the cylindrical element 44 which is axially moveable together with the plate 32.

For the purpose of adjusting the limit positions for the axial movement of the plate 32, and therewith the limit positions for rotation of the blades 12, stop shoulders 55 (FIG. 1) and 56 (FIG. 2) are arranged on opposite sides of the plate 32. In the illustrated embodiment, the stop shoulders 55, 56 comprise nuts and washers axially settable on the associated screw-threaded pins 57. The pins 57 are arranged in uniform angular distribution around the shaft 14 and at one end are axially adjustably connected with the hub part 16 and at their other end are guided in sleeves 58 in the shield element 52. The plate 32 at that part thereof where the pins 57 pass therethrough is provided with slots, as illustrated at 59 FIG. 3, which permit both displacement and rotation of the plates 32 relative to the axis of the fan wheel 10. In the illustrated embodiment, the plate 32 is guyed or supported by means of a reinforcing ring 60 which extends obliquely between said plate 32 and the part 33 and which is provided with holes for the pins 57 and with sleeves 61 against which the stops 55 can engage. These holes and sleeves have also an elongate or slot-like cross-section, which permits the requisite displacement and rotation of the plate 32.

The invention is not restricted to the described and illustrated embodiment thereof, but can be modified within the scope of the following claims.

I claim:

1. An axial fan having a fan wheel with settable blades, comprising in combination:

(a) a hub having a central hub portion mounted on a fanwheel driving shaft, a hub rim, and hub rim mounting means extending substantially radially outwardly from said hub portion to the hub rim for rigidly interconnecting said hub portion and said hub rim, (b) blade attachment shafts having inner ends rigidly mounted to the hub rim and outer ends extending radially outwardly from said hub rim, (c) fan blades having ends connected to an outer end of a respective blade attachment shaft via bearings for journalling said blades for rotation about the associated blade attachment shaft, (d) sealed blade bearing housings rigidly connected to the root end of a respective fan blade and surrounding the outer end of the associated blade attachment shaft, (e) blade setting arms rigidly connected to and projecting from respective blade bearing housings substantially radially relative to a blade setting axis, said arms having a sealed bearing housing formed in outer ends thereof, (f) a blade setting device which is common to all fan blades and which is axially displaceable and coaxially rotatable relative to the fan wheel, (g) movement transmission arms having radially inner ends rigidly connected to the setting device and radially outer ends journalled in the sealed bearing housing in the outer end of a respective blade setting arm for both substantially radial movement relative to the fan wheel and universal movement, and (h) chambers formed in said blade attachment shafts and extending radially inwardly of the associated blade bearing housing and setting arm bearing housing, said chambers being arranged to contain a suitable substance, such as lubricating or protecting agent, and communicating with said associated bearing housings in a manner such that the substance is pressed into said bearing housings by centrifugal force during operation of the fan.

2. An axial fan according to claim 1, wherein the blade attachment shafts have the form of tubes and are abutted at their radially inner ends against the radially outer side of the hub rim, the interior of said shafts forming said chambers for the suitable substance.

3. An axial fan according to claim 2, wherein each blade-bearing housing communicates with the bearing housing in the associated setting arm, the latter bearing housing communicating with said chamber via the blade-bearing housing.

* * * * *